US005316487A

United States Patent [19]

Clark

[11] Patent Number: 5,316,487

[45] Date of Patent: May 31, 1994

[54] SPACER FOR BOARD MOUNTED CONNECTORS

[75] Inventor: Stephen L. Clark, Dillsburg, Pa.

[73] Assignee: E. I. Du Pont de Nemours and Company, Wilmington, Del.

[21] Appl. No.: 33,444

[22] Filed: Mar. 18, 1993

Related U.S. Application Data

[63] Continuation of Ser. No. 820,026, Jan. 10, 1992, abandoned, which is a continuation of Ser. No. 515,544, Apr. 24, 1990, abandoned, which is a continuation of Ser. No. 271,154, Nov. 14, 1988, abandoned.

[51] Int. Cl.[5] ..... H01R 23/72

[52] U.S. Cl. ..... 439/78; 439/573

[58] Field of Search ..... 439/55, 78, 81, 82, 439/83, 562, 563, 564, 565, 569, 570, 571, 572, 573; 174/138 D

[56] References Cited

U.S. PATENT DOCUMENTS 3,993,384 11/1976 Dennis et al. ..... 439/71
4,173,387 11/1979 Zell ..... 439/78
4,363,530 12/1982 Verhoeven ..... 439/78

FOREIGN PATENT DOCUMENTS 918814 1/1973 Canada .

OTHER PUBLICATIONS

Du Pont HPC Connector System, Bulletin 712, Jan. 1987, pp. 13–15.

*Primary Examiner*—Neil Abrams
*Attorney, Agent, or Firm*—Woodcock, Washburn, Kurtz, Mackiewicz, & Norris

[57] ABSTRACT

A spacer is disposed in abutting relationship between the outer surfaces of a pin header and a shroud as the same are mounted to opposed major surfaces of a board. As a result, the pins of the header extend for substantially the same distances from the bases of the header and the shroud into the pockets thereof.

50 Claims, 2 Drawing Sheets

SPACER FOR BOARD MOUNTED CONNECTORS

This is a continuation-in-part continuation, of application Ser. No. 07/820,026 filed Jan. 10, 1992 now abandoned itself a continuation of 07/515,544 filed Apr. 24, 1990, now abandoned, itself a continuation of Ser. No. 07/271,154 filed Nov. 14, 1988, now abandoned.

FIELD OF THE INVENTION

The present invention relates to board mounted connectors, and, in particular, to a spacer for use with such connectors.

DESCRIPTION OF THE PRIOR ART

It is common practice in the electronics industry to mount a first connector on a first major surface of a suitable substrate, such as a circuit board, and a second connector on the opposed major surface of the substrate. The first connector may have either a male or female termination accessible from the first surface of the substrate. This first connector also has, in the typical case, an array of pins extending from the outer surface of the base thereof. The pins extend through openings provided in the substrate and through apertures formed in the base of the second connector. The pins are presented for connection from the second surface of the substrate.

In a common implementation of such a dual connector arrangement a pin header and a corresponding shroud are provided on each of the opposed major surfaces of the board. A pin header is an elongated insulated housing having a base with upstanding end and side walls which together cooperate to enclose a generally rectangular volume, or pocket. An array of pins is affixed to the base of the header such that a first portion of each pin extends into the pocket to dispose the tip of the pin a first predetermined distance from the inner surface of the base. A second portion of the pin extends from the outer surface of the base. The header is mounted onto the first major surface of the circuit board such that each of the pins extending from the outer surface of the base of the header passes through one of a corresponding plurality of openings provided in the board.

The shroud is mounted on the opposed major surface of the board. The shroud is an elongated member configured in a manner generally similar to the pin header, except that the base portion thereof is provided with a plurality of apertures that correspond in location and arrangement to the array of openings in the board and, thus, to the arrangement of pins in the header. The extending portions of the pins project through the apertures in the base of the shroud so as to extend a predetermined distance into the pocket of the shroud.

It is desirable in practice that a substantially equal length of pin extend into the pockets of both the pin header and the shroud. That is to say, it is desirable that the tips of the pins are disposed substantially equal distances above the inner surfaces of the bases of both the pin header and of the shroud. If a tip of a pin extends from the base of the header or shroud for either too great or too small a distance proper electrical interconnection between the pins in the header or shroud, as the case may be, would be not be attainable. Moreover, some electrical specifications, such as the DIN standards, mandate equality in the distances that the pins extend from the base of the header and from the base of the shroud.

In practice, the thickness of the circuit board on which the header and shroud are mounted varies significantly. As a typical example a board may vary up to ten percent (10%) in actual thickness. Thus, a board on the order of 0.2 inches nominal thickness may actually have a thickness dimension anywhere in the range from 0.18 inches to 0.22 inches. Such variations in board thickness make it difficult to insure that the lengths of the pins projecting into the pockets of the header and of the shroud meet the prescribed requirements.

U.S. Pat. No. 4,363,530 (Verhoven), assigned to the assignee of the present invention, discloses and claims a spacer arrangement that includes a generally cylindrical spacer member that operates between one major surface of the board and the undersurface of one of either the header or the shroud to accommodate thickness variations in the board. In this arrangement the shroud and the header are held together by an elongated peg which is inserted through a bore in either the header or the shroud, through a bore provided in the spacer, and into a corresponding bore on the other of the shroud or header. One end of the spacer is provided with a helical rim which engages against abutments provided on the member with which it is in contact. Rotation of the spacer about the axis of the peg tightens the connection of the header and the shroud to the circuit board and thereby accomodates any variations in the thickness of the board.

In view of the foregoing, it is believed advantageous to provide an alternative arrangement whereby variations in board thickness may be disregarded.

SUMMARY OF THE INVENTION

The present invention relates to a spacer for connectors mounted to opposed major surfaces of a circuit board where one of the connectors has an array of pins extending from the outer surface of the base thereof. The spacer accommodates variations in the thickness of the board and permits the distance that the tips of the pins extend into a pocket in the other connector to be accurately controlled. The spacer is extensible through a passage in the board into abutting contact with the outer surfaces of both the connectors. The spacer is manufacturable such that the axial dimension thereof is able to be closely controlled and substantially precisely reproducible. Thus, when the spacer is secured in abutting relationship to the connectors the distance that the pins extend into the pocket of the second connector is precisely controlled.

The spacer in accordance with this invention may be used in any dual connector application in which is is desired to control the distance that pins projecting from the outer surface of a first connector extend into the pocket of a second connector mounted on the opposed surface of a substrate. The first connector may have either male or female terminations presented into the pocket thereof. In particular, the spacer is applicable to arrangements having a pin header on a first surface of the board and a shroud disposed on the second surface of the board. The spacer is able to insure that the pins in the header and the shroud extend into the pockets thereof for the same predetermined distance as measured from the inner surfaces of the bases of the header and of the shroud. The spacer(s) may be separate from or integral with one or both of the header or the shroud.

BRIEF DESCRIPTION OF THE DRAWINGS

The invention will be more fully understood from the following detailed description thereof, taken in connection with the accompanying drawing, which forms a part of this application, and in which FIG. 1 a side elevational view entirely in section illustrating various aspects of spacer in accordance with the present invention as applied in dual board-mounted connector arrangements while

DETAILED DESCRIPTION OF THE INVENTION

Figure 1:
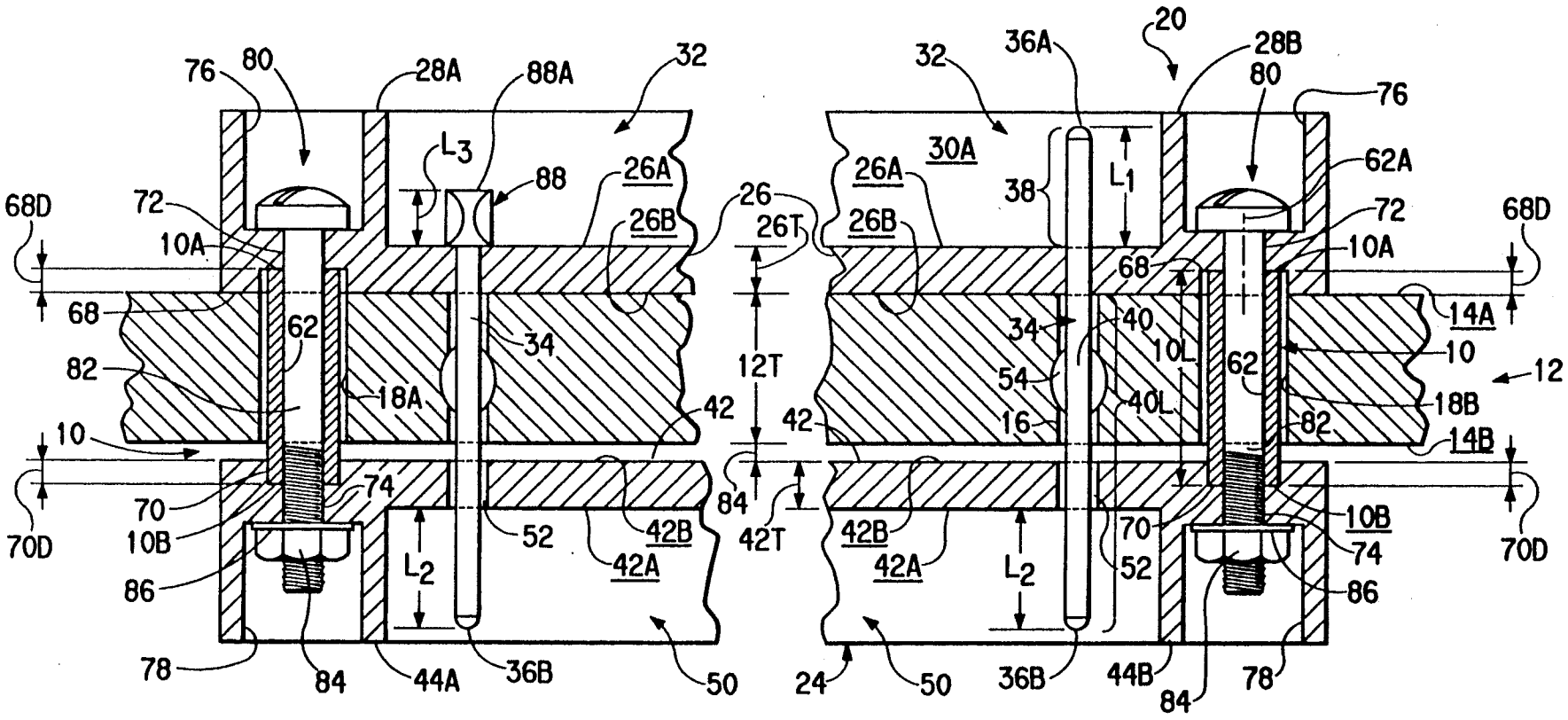

Throughout the following detailed description similar reference numerals refer to similar elements in all Figures of the drawings.

With reference to the Figures shown is a circuit board 12 with which the spacer 10 in accordance with the present invention may be utilized. The board 12 has a thickness dimension 12T associated therewith and first and second opposed major surfaces 14A and 14B thereon. The board 12 has an array of openings 16 arranged in a predetermined pattern therein for a purpose to be described. In addition, a first and a second passage 18A and 18B, respectively, are provided in the board 12 laterally of the array of openings 16 therein.

Mounted to the opposed surfaces 14A, 14B of the board 12 is a dual connector arrangement comprised of connectors 20 and 24, respectively. The right portion of each of the Figure illustrates one particular common dual connector arrangement wherein the first connector 20 takes the form of a pin header while the second connector 24 is a shroud. The left hand portion of each of the figures illustrates another common implementation in which the first connector 20 has female terminations accessible from the first surface of the board and pins projecting from the outer surface of the base thereof, while the second connector 24 is a shroud. It is understood from the Figures that although only one ends of each of the connectors 20, 24 is shown in connection with a given implementation, the connectors have an opposite lateral end thereon, at which, in the typical case, the same spacer arrangement is provided.

With reference to the right hand portion of FIG. 1, the pin header 20 and a corresponding pin shroud 24 on the opposed major surfaces 14A and 14B. respectively of the board 12. The pin header 20 includes a generally elongated housing formed of a generally planar base portion 26, upstanding opposed end walls 28A and 28B, and a pair of opposed side walls, only the inner surface 30A of one of which being visible in the Figure. The end walls 28A, 28B are laterally enlarged or thickened, for a purpose to be described. The base 26 has a predetermined thickness dimension 26T. an inner surface 26A and an outer surface 26B thereon. The inner surface 26A of the base 26 and the endwalls 28A, 28B and the sidewalls cooperate to enclose a generally open topped volume or pocket 32. The header 20 is typically formed by injection molding from an insulated material, such as plastic. Owing to the method in which the header 20 is manufactured the thickness dimension 26T of the base 26 of the header 20 is precisely controllable to within a very close tolerance.

An array of elongated pins 4 is, in the typical case, molded, loaded or otherwise suitably attached into the material of the base 26 of the pin header 20. Each pin 34 has a first end 36A and a second end 36B therein. A first portion 38 of each pin 34 extends into the pocket 32 such that the first end 36A is spaced a predetermined distance $L_1$ from the inner surface 26A of the base 26. A portion 40 of the pins 34 having a length dimension 40L associated therewith extends from the outer surface 26B of the base 26 of the header 20. The pins 34 are arranged in a predetermined pattern in the base 26 of the header 20. The pattern of the openings 16 in the base 26 corresponds to the pattern of the pins 34 in the header 20.

The shroud 24 also includes a generally elongated housing having a generally planar base portion 42, laterally enlarged or thickened upstanding opposed end walls 44A and 44B, and a pair of opposed side walls, only one of which, the inner surface 46A, is visible in the Figure. The base 42 has an inner surface 42A and an outer surface 42B thereon. The base 42 has a thickness dimension 42T associated therewith. The inner surface 42A of the base 42, the endwells 44A. 44B and the sidewalls cooperate to enclose a generally open topped volume or pocket 50. The shroud 24 is also formed in the typical case by injection molding from an insulated material, such as plastic. The base 42 of the shroud 24 has an array of apertures 52 therein. The apertures 52 are arranged in a pattern corresponding to the pattern of the pins 34. As in the case of the header, owing to the method in which the shroud 24 is manufactured the thickness dimension 42T of the base 42 of the shroud 24 is precisely controllable to within a very close tolerance.

The portion 40 of each of the pins 34 extending from the outer surface 26B of the base 26 of the header 20 passes through the pin openings 16 provided in the board 12. This portion 40 of the pins 34 is staked or otherwise suitable affixed to the board 12, as shown at 54. The shroud 24 is received on the second major surface 14B of the board 12 such that the part of the extending portion 40 each of the pins 34 that extends past the second major surface 14B of the board 12 is received within a corresponding one of the apertures 52 provided in the base 42 of the shroud 24. The pins 34 are received within the pocket 50 of the shroud 24 such that the second end 36B of each pin 34 lies a second distance $L_2$ from the inner surface 42A of the base 42 thereof.

The maximum thickness dimension 12T of the board 12, the thickness dimension 42T of the base 42 of the shroud 24, and the distance $L_2$ are related to the length 40L of the projecting portion 40 of the pin 34. Symbolically, $$\text{Maximum Board Thickness } 12T + \text{Thickness } 42T + \text{Distance } L_2 = \text{Length } 40L.$$

As noted in the earlier discussion, it is advantageous, desirable, and necessary that in the case of a board mounted pin header and corresponding shroud the distance $L_2$ be substantially equal to the distance $L_1$. Accordingly, proper selection of the thickness 12T of the board 12 should insure that the second end 36B of the pins 34 extends the predetermined distance $L_2$ into the shroud 24. However, also as discussed earlier, the thickness dimension 12T of the board 12 is subject to dimensional inconsistencies. Such inconsistencies make unreliable the control of the distance $L_2$ based on the accurate reproduciblily of board thickness. As a result, if the header 20 and the shroud 24 were to be mounted directly against the major surfaces 14A, 14B of the board 12 the dimensional inconsistencies in the thickness 12T of from one board to another would lead to differences in the distance $L_2$ that the end 36B of the pins 34 extends into the pocket 50.

However, in accordance with this invention, a spacer generally indicated at reference character 10 is arranged to abut against the outer surfaces 26B, 42B of the bases 26, 42 of the header 20 and the shroud 42, respectively. The spacer 10 has a predetermined axial dimension 10L associated therewith which makes possible the desired substantial equality of the distances $L_1$ and $L_2$ without regard to variations in the thickness 12T of the board 12 from its nominal dimension.

In the preferred implementation the spacer 10 is a generally cylindrical member having a cylindrical bore 62 extending centrally and axially therethrough. It should, of course, be understood that the exterior configuration of the spacer 10 may be other than a right circular cylinder and that the bore 62 therethrough can be other than circular in cross-section. The end surfaces 10A, 10B of the spacer 10 are planar and lie perpendicular to the axis 62A of the bore 62 therethrough.

In accordance with this invention a spacer 10 is inserted through each of the passages 18 in the board 12 prior to the introduction of the shroud 24 onto the second major surface 14B of the board 10. The passages 18A, 18B are dimensioned to loosely accept the spacer 10 as it passses therethrough. The first end 10A of the spacer 10 is abutted against the lower surface 26B of the header 20 while the second end 10B of the spacer 10 abuts against the lower surface 42B of the shroud 42. When the spacer 10, the header 20 and the shroud 24 are secured together, owing to the dimensional relationship of the spacer 10, the extending length 40L of the pins 34 and the thickness 42T of the shroud 42, the end 36B of each pin 34 extends substantially same distance from the inner surface 42A of the base of the shroud 24 as does the tip 36A from the inner surface 26A of the base 26 of the header 20. Moreover, since the spacer 10, the header 20 and the shroud 24 are molded, the dimensionality of these parts can be more accurately governed and reliance thereon more reasonably placed. Thus the uncontrollable dimensional inconsistencies associated with the board 12 are avoided and replaced by the controllable dimensionality of injection molded parts.

Although the spacer 10 may be mounted in the abutting relationship with the outer surfaces 26B, 42B of the bases 26, 42 of the header 20 and shroud 24, respectively, at any convenient location thereon, in the preferred instance these outer surface 26B,42B are mounted in the vicinity of the lateral ends of the header or shroud, as the case may be. Moreover, to facilitate the abutting relationship, the outer surfaces 26B, 42B are provided with respective recesses 68, 70 in the area of the thickened end walls 28A, 28B of the header 20 and the thickened end walls 44A, 44B of the shroud 24. The recesses 68, 70 have predetermined depth dimensions 68D, 70D, respectively associated therewith. The depth dimensions 68D, 70D are measured with respect to the axis of the spacer 10. In addition, the end walls 28A, 28B and 44A, 44B are provided with a.,dally extending mounting bores 72, 74, respectively. Preferably the end walls are also provided with enlarged counterbores 76, 78, which respectively communicate with the bores 72, 74. The mounting bores 72, 74 register axially with the passages 18 in the board 12.

Thus, in the assembled relationship shown in the right-hand portion of the Figure, the ends 10A, 10B of the spacer 10 are respectively received within the recesses 68, 70 on the outer surface 26B, 42B of the bases 26, 42 of the header 20, 24, respectively. Attachment means 80, preferably in the form of an elongated threaded bolt 82 and a corresponding lock nut 84 (with a washer 86, if desired) is used to secure the spacer 10 together with the header 20 and the shroud 24. The bolt 82 is introduced through the registered mounting bores 62, 72, and 74 in the spacer 10, the header 20 and the shroud 24, respectively. It is specifically noted that in accordance with the present invention the spacer 10 does not act against either major surface 14A, 14B of the board 12, but instead acts in an abutting relationship directly against the header 20 and the shroud 24. In practice, if the board thickness deviates from its desired maximum, a clearance gap 84 will defined between the outer surface 42B of the base 42 of the shroud 24 and the second major surface 14B of the board 10. The dimension of the gap 84 will vary, depending on the thickness dimension 12T of the board 12.

Since the length 10L of the spacer 10 can be controlled to a relatively fine tolerance as compared to the dimension of the thickness of the board, utilization of the spacer arrangement disclosed in accordance with this invention will secure the header and shroud while at the same time insure that the ends of the pins project into the pockets of the header and the shroud for substantially the same distance. That is, using the spacer 10 described heretofore, the distance $L_2$ is substantially equal to the distance $L_1$. In practice, the length 10L of the spacer 10 is determined by the maximum board thickness 12T plus the depth dimension 68D, 70D of any of the recesses 68, 70 provided. Thus, if the spacer 10 is to abut directly against the outer surfaces of the bases of the shroud and the header, the length 10L of the spacer 10 is made equal to the maximum thickness dimension of the board. If one or more recesses 68, 70 are provided, the length 10L of the spacer 10 is increased by corresponding depth(s) of the recess(es) provided.

The left side of the Figure illustrates another arrangement with which the spacer in accordance with the present invention can be utilized. In this implemenation one of the connectors, for example, the connector 20, may be provided with female terminals 88 which are presented to and accessible from the first surface 14A of the board. The tip 88A of the female terminal 88 extends a predetermined distance $L_3$ from the inner surface 26A of the base 26 of the connector 20. The portion of the female terminal 88 extending from the outer surface 26B of the base 26 is identical to the portion 40 discussed in connection with the implementation shown in the right hand portion of the Figure. That is, a pin having a length 40L extends from the outer surface 26B of the base 26 of the connector 20. In this implementation it is not as critical that the distances $L_2$ and $L_3$ extend for the same distances above their respective bases 26 and 42. The spacer 10 may still be used, however, to control the distance $L_2$ that the tip 36B of the pin portion 40 lies from the inner surface 42A of the base 42 of the connector 24. The spacer 10 is receivable in abutting contact between the outer surface 26B of the base 26 of the first connector 20 and the outer surface 42B of the base 42 of the second connector 24. The spacer 10 has a predetermined axial dimension 10L associated therewith, in this instance the axial dimension 10L being selected such that when the spacer 10, the first connector 20, and the second connector 24 are secured together, the end 36B of the pin portion 40 extends from the inner surface 42A of the base 42 for the predetermined distance $L_2$.

It should be noted the same relationship between the board thickness 12T, the thickness 26T and the length $L_2$ as discussed earlier applies to the implementation shown in the left hand portion of the Figure. Thus, the length 10L of the spacer 10 is again determined by the maximum board thickness 12T plus the depth dimension 68D, 70D of any of the recesses 68, 70 provided. If the spacer 10 is to abut directly against the outer surfaces of the bases of the first and second connectors, the length 10L of the spacer 10 is made equal to the maximum thickness dimension 12T of the board. If one or more recesses 68, 70 are provided, the length 10L of the spacer 10 is increased by corresponding depth(s) of the recess(es) provided.

Figure 2:
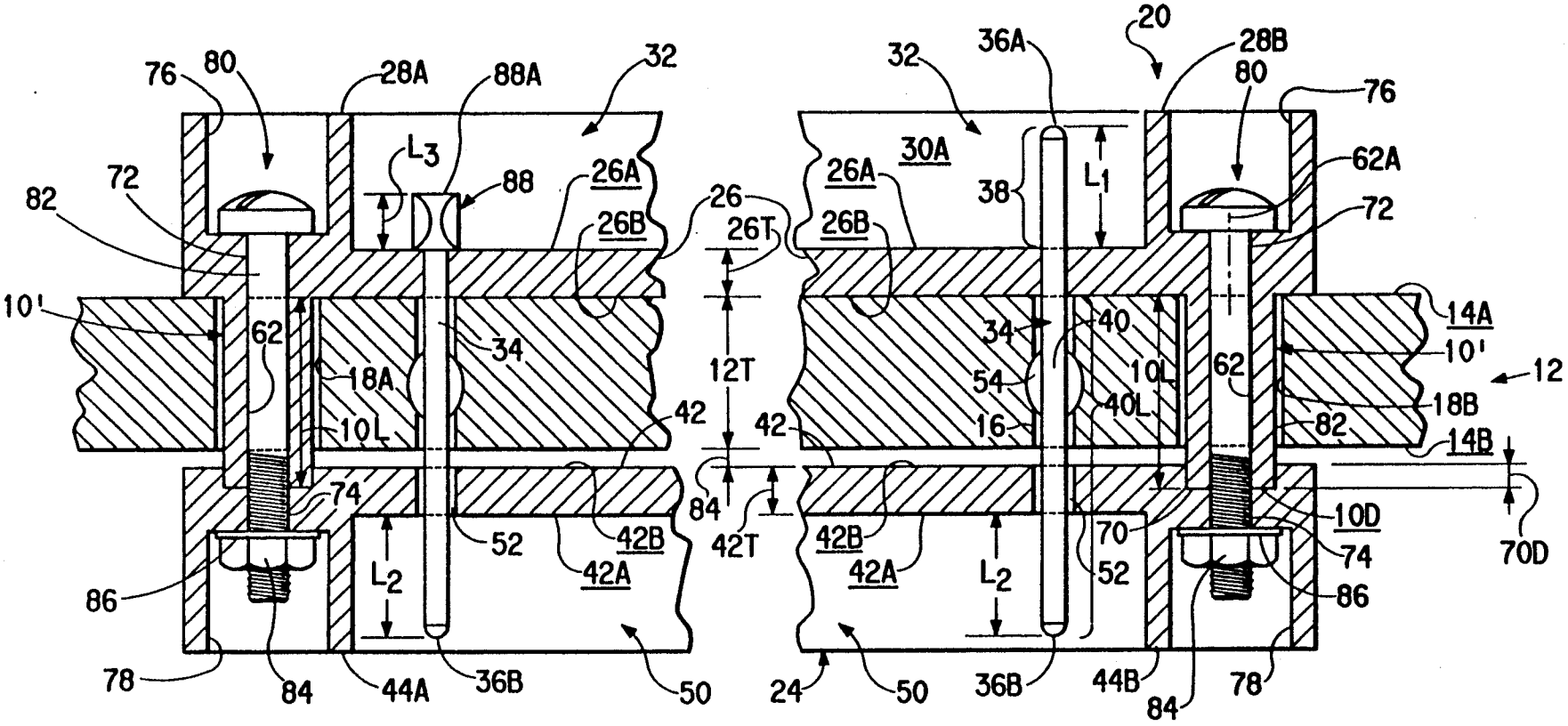
FIG. 2 is a view generally similar to FIG. 1 illustrating alternate embodiments of the present invention.

Those skilled in the art having the benefit of the teachings in the present invention as hereinbefore set forth may effect numerous modifications thereto. It should be understood that the spacer 10 need not be a separate member, but may instead be molded integrally with either the header or the shroud. For example, one or both of the spacers can be made integral with one of the connectors, or the housing of each of the connectors may be provided with an integral spacer. These alternate embodiments of the invention are illustrated in FIG. 2. In FIG. 2 the spacer 10' is shown as being molded integrally with the plastic housing of the first connector 20. FIG. 2 also serves to illustrate the situation in which both of the spacers are provided on the connector 20. In any of these implementations the length 10'L of the spacer 10' is determined in the same manner as in the case of the spacer 10, as earlier discussed. The axial dimension 10'L is selected such that when the connector with the spacer 10' and the other connector are secured together (as by the bolt 82 and the nut 84) the ends 36B of the pins 34 extend from the inner surface of the base 42A of the connector 24 for a predetermined distance $L_2$. Thus, the spacer 10' has an axial dimension 10'L that is equal to the maximum thickness dimension of the board. As seen in FIG. 2, the axial dimension 10'L is measured from the surface of the base of the connector with which the spacer is integral. Similar to the discussion above, on the connector not having a spacer, a recess 70 may be provided. It should be understood, however, that this and other such modifications are to be construed as lying within the contemplation of the present invention as defined by the appended claims.

What is claimed is:

1. Connector apparatus comprising:

a first connector having a base with an outer surface thereon, a predetermined plurality of pins extending from the outer surface of the base of the header, each pin having a tip thereon, each pin having a predetermined length measured from the outer surface of the base to the tip of the pin, a second connector having a base with an inner and an outer surface thereon, the base of the second connector having a predetermined thickness dimension associated therewith and an array of apertures therein, the apertures corresponding in number and location to the number and location of the pins extending from the outer surface of the base of the first connector, the pins being receivable into the apertures in the base of the second connector;

a spacer receivable in abutting contact between the outer surface of the base of the first connector and the outer surface of the base of the second connector, the spacer having a predetermined axial dimension associated therewith, the axial dimension being selected such that when the spacer, first connector, and the second connector are secured together, the end of the pins extend from the inner surface of the base of the second connector for a predetermined distance L;

the spacer has an axial bore therethrough, the first connector and the second connector each have a mounting bore therethrough, the bores in the spacer, the first connector and the second connector being coaxially disposed when the first connector, the spacer and the second connector are secured together; and means for securing together the spacer, the first connector and the second connector, the securing means comprising a bolt extensible through the registered bores in the spacer, the first connector and the second connector and a nut attachable to the bolt.

2. The apparatus of claim 1 wherein the spacer has a first end and a second end thereon, and wherein the outer surface of the first connector has a recess therein sized to accommodate one end of the spacer.

3. The apparatus of claim 2 wherein the the outer surface of the second connector has a recess therein sized to accommodate the second end of the spacer.

4. The apparatus of claim 1 wherein the spacer has a first end and a second end thereon, and wherein the outer surface of the second connector has a recess therein sized to accommodate one end of the spacer.

5. The apparatus of claim 3 further comprising:

a circuit board disposed between the connectors and having a passage therein, the passage being sized to receive the spacer as the same extends therethrough.

6. The apparatus of claim 2 further comprising:

a circuit board disposed between the connectors and having a passage therein, the passage being sized to receive the spacer as the same extends therethrough.

7. The apparatus of claim 1 further comprising:

a circuit board disposed between the connectors and having a passage therein, the passage being sized to receive the spacer as the same extends therethrough.

8. Connector apparatus comprising:

a header having a base with an inner and an outer surface thereon, a plurality of pins secured within the base of the header, the pins being arranged in a predetermined pattern, each pin having a first and a second end thereon, a first portion of each pin extending from the base of the header to dispose the first end of each pin a first predetermined distance $L_1$ from the inner surface of the base of the header, a second portion of each pin being disposed a second predetermined distance from the outer surface of the base of the header;

a shroud having a base with an inner and an outer surface thereon, the base of the shroud having an array of apertures therein, the apertures corresponding in number and location to the number and location of the portion of the pins extending from the outer surface of the base of the header, the second portion of the pins being receivable into the apertures in the base of the shroud;

a spacer receivable between the outer surface of the base of the header and the outer surface of the base of the shroud, the spacer having a predetermined axial dimension selected such that when the spacer, header, and shroud are secured together, the second end of the pins extend from the inner surface of the base of the shroud for a distance $L_2$ equal to the predetermined distance $L_1$;

the spacer has an axial bore therethrough, the header and the shroud each have a mounting bore therethrough, the bores in the spacer, the header and the shroud being coaxially disposed when the header, the spacer and the shroud are secured together; and means for securing together the spacer, the first connector and the second connector, the securing means comprising a bolt extensible through the register bores in the spacer, the first connector and the second connector and a nut attachable to the bolt.

9. The apparatus of claim 8 wherein the spacer has a first end and a second end thereon, and wherein the outer surface of the header has a recess therein sized to accommodate one end of the spacer.

10. The apparatus of claim 9 wherein the the outer surface of the shroud has a recess therein sized to accommodate the second end of the spacer.

11. The apparatus of claim 8 wherein the spacer has a first end and a second end thereon, and wherein the outer surface of the shroud has a recess therein sized to accommodate one end of the spacer.

12. The apparatus of claim 11 further comprising:

a circuit board disposed between the header and shroud and having a passage therein, the passage being sized to receive the spacer as the same extends therethrough.

13. The apparatus of claim 9 further comprising:

a circuit board disposed between the header and shroud and having a passage therein, the passage being sized to receive the spacer as the same extends therethrough.

14. The apparatus of claim 8 further comprising:

a circuit board disposed between the header and shroud and having a passage therein, the passage being sized to receive the spacer as the same extends therethrough.

15. The apparatus of claim 8 further comprising:

a circuit board disposed between the header and shroud and having a passage therein, the passage being sized to receive the spacer as the same extends therethrough.

16. The apparatus of claim 15 wherein the board has a predetermined maximum thickness dimension and wherein the axial dimension of the spacer is equal to the maximum thickness dimension of the board.

17. The apparatus of claim 14 wherein the board has a predetermined maximum thickness dimension and wherein the axial dimension of the spacer is equal to the maximum thickness dimension of the board.

18. The apparatus of claim 13 wherein the board has a predetermined maximum thickness dimension and the recess in the header has a predetermined depth dimension, and wherein the axial dimension of the spacer is equal to the sum of the maximum thickness dimension of the board plus the depth dimension of the recess in the header.

19. The apparatus of claim 12 wherein the board has a predetermined maximum thickness dimension and the recess in the shroud has a predetermined depth dimension, and wherein the axial dimension of the spacer is equal to the sum of the maximum thickness dimension of the board plus the depth dimension of the recess in the shroud.

20. The apparatus of claim 10 wherein the board has a predetermined maximum thickness dimension, the recess in the header has a first predetermined depth dimension, and the recess in the shroud has a second predetermined depth dimension, and wherein the axial dimension of the spacer is equal to the maximum thickness dimension of the board plus the first depth dimension and the second depth dimension.

21. The apparatus of claim 7 wherein the board has a predetermined maximum thickness dimension, and wherein the axial dimension of the spacer is equal to the maximum thickness dimension of the board.

22. The apparatus of claim 1 wherein the board has a predetermined maximum thickness dimension, and wherein the axial dimension of the spacer is equal to the maximum thickness dimension of the board.

23. The apparatus of claim 6 wherein the board has a predetermined maximum thickness dimension, and wherein the recess in the first connector has a predetermined depth dimension, and wherein the axial dimension of the spacer is equal to the maximum thickness dimension of the board plus the depth dimension of the recess in the first connector.

24. The apparatus of claim 5 wherein the board has a predetermined maximum thickness dimension, wherein the recess in the first connector has a first predetermined depth dimension, and wherein the recess in the second connector has a second predetermined depth dimension, and wherein the axial dimension of the spacer is equal to the maximum thickness dimension of the board plus the first depth dimension and the second depth dimension.

25. Connector apparatus comprising:

a first connector having a base with an outer surface thereon, a predetermined plurality of pins extending from the outer surface of the base of the connector, each pin having a tip thereon, each pin having a predetermined length measured from the outer surface of the base to the tip of the pin;

a second connector having a base with an inner and an outer surface thereon, the base of the second connector having an array of apertures therein, the apertures corresponding in number and location to the number and location of the pins extending from the outer surface of the base of the first connector, the pins being receivable into the apertures in the base of the second connector;

one of the connectors having a spacer formed integrally therewith, the spacer extending from the outer surface of the base of the one connector, the spacer having a predetermined axial dimension associated therewith, the axial dimension being selected such that when the one connector with the spacer and the other connector are secured together, the end of the pins extend from the inner surface of the base of the second connector for a predetermined distance L, the space being generally cylindrical in shape and having a cylindrical bore extending centrally and axially therethrough, the first connector and the second connector each have a bore therethrough, the bores in the spacer, the first connector and the second connector being coaxially disposed when the same are secured together, and means for securing together the first connector and the second connector, the securing means comprising a bolt extensible through the registered bores in the spacer, the first connector and the second connector and a nut attachable to the bolt.

26. The apparatus of claim 25 wherein the spacer has an end thereon, and wherein the outer surface of the other of the connectors has a recess therein sized to accommodate the end of the spacer.

27. The apparatus of claim 26 further comprising: a circuit board disposed between the first and the second connectors, the board having a passage therein, the passage being sized to receive the spacer as the same extends therethrough.

28. The apparatus of claim 25 further comprising: a circuit board disposed between the first and the second connectors, the board having a passage therein, the passage being sized to receive the spacer as the same extends therethrough.

29. The apparatus of claim 28 wherein the board has a predetermined maximum thickness dimension, and wherein the axial dimension of the spacer is equal to the maximum thickness dimension of the board.

30. The apparatus of claim 27 wherein the recess in the second connector has a predetermined depth dimension, and wherein the axial dimension of the spacer is equal to the maximum thickness dimension of the board plus the depth dimension.

31. The apparatus of claim 25 wherein the one connector has a second spacer formed integrally therewith, the second spacer being generally cylindrical in shape and having a cylindrical bore extending centrally and axially therethrough, the second spacer extending from the outer surface of the base of the one connector, the second spacer having a predetermined axial dimension associated therewith, the axial dimension being selected such that when the one connector with the first and the second spacers and the other connector are secured together, the end of the pins extend from the inner surface of the base of the second connector for a predetermined distance L.

32. The apparatus of claim 31 wherein the second spacer has an end thereon, and wherein the outer surface of the other connector has a second recess therein sized to accommodate the end of the second spacer.

33. The apparatus of claim 32 further comprising: a circuit board disposed between the first and the second connectors, the board having a second passage therein, the second passage being sized to receive the second spacer as the same extends therethrough.

34. The apparatus of claim 31 further comprising: a circuit board disposed between the first and the second connectors, the board having a second passage therein, the second passage being sized to receive the second spacer as the same extends therethrough.

35. The apparatus of claim 34 wherein the axial dimension of the second spacer is equal to the maximum thickness dimension of the board.

36. The apparatus of claim 33 wherein the recess in the second connector has a second predetermined depth dimension, and wherein the axial dimension of the second spacer is equal to the maximum thickness dimension of the board plus the second depth dimension.

37. The apparatus of claim 31 wherein the first connector and the second connector each have bores therethrough, the bores in the first spacer, the first connector and the second connector being coaxially disposed when the same are secure together, the bores in the second spacer, the first connector and the second connector being coaxially disposed when the same are secured together, the bolt of the securing means extending through the registered bores in the first spacer, the first connector and the second connector the securing means further comprising a second bolt extensible through the registered bores in the second spacer, the first connector and the second connector and a nut attachable to the second bolt.

38. Connector apparatus comprising:

a header member having a base with an inner and an outer surface thereon, a predetermined plurality of pins secured within the base of the header, the pins being arranged in a predetermined pattern, each pin having a first and a second end thereon, a first portion of each pin extending from the base of the header to dispose the first end of each pin a first predetermined distance $L_1$ from the inner surface of the base of the header, a second portion of each pin being disposed a second predetermined distance from the outer surface of the base of the header;

a shroud member having a base with an inner and an outer surface thereon, the base of the shroud having an array of apertures therein, the apertures corresponding in number and location to the number and location of the portion of the pins extending from the outer surface of the base of the header, the second portion of the pins being receivable into the apertures in the base of the shroud;

one of the header member or the shroud member having a spacer formed integrally therewith, the spacer extending from the outer surface of the base of the one member and being receivable between the outer surface of the base of the header and the outer surface of the base of the shroud, the spacer having a predetermined axial dimension associated therewith, the axial dimension being selected such that when the header and shroud are secured together the second end of the pins extend from the inner surface of the base of the shroud for a predetermined distance $L_2$ each to the predetermined distance $L_1$ the spacer being generally cylindrical in shape and having a cylindrical bore extending centrally and axially therethrough, the header and the shroud each have a bore therethrough, the bores in the spacer, the header and the shroud being coaxially disposed when the same are secured together, and means for securing together the header and the shroud, the securing means comprising a bolt extensible through the registered bores in the spacer, the header and the shroud and a nut attachable to the bolt.

39. The apparatus of claim 38 wherein the spacer has an end thereon, and wherein the outer surface of the other of the members has a recess therein sized to accommodate the end of the spacer.

40. The apparatus of claim 39 further comprising: a circuit board disposed between the header and the shroud, the board having a passage therein, the passage being sized to receive the spacer as the same extends therethrough.

41. The apparatus of claim 38 further comprising: a circuit board disposed between the header and the shroud, the board having a passage therein, the passage being sized to receive the spacer as the same extends therethrough.

42. The apparatus of claim 41 wherein the board has a predetermined maximum thickness dimension, and wherein the axis dimension of the spacer is equal to the maximum thickness dimension of the board.

43. The apparatus of claim 40 wherein the recess in the second member has a predetermined depth dimension, and wherein the axial dimension of the spacer is equal to the maximum thickness dimension of the board plus the depth dimensions.

44. The apparatus of claim 38 wherein the one member has a second spacer formed integrally therewith, the second spacer being generally cylindrical in shape and having a cylindrical bore extending centrally and axially therethrough, the second spacer extending from the outer surface of the base of the one member, the second spacer having a predetermined axial dimension associated therewith, the axial dimension being selected such that when the one member with the first and the second spacers and the other member are secured together, the end of the pins extend from the inner surface of the base of the shroud for the predetermined distance $L_2$ equal to the distance $L_1$.

45. The apparatus of claim 44 wherein the second spacer has an end thereon, and wherein the outer surface of the other member has a second recess therein sized to accommodate the end of the second spacer.

46. The apparatus of claim 45 further comprising: a circuit board disposed between the first and the second members, the board having a second passage therein, the second passage being sized to receive the second spacer as the same extends therethrough.

47. The apparatus of claim 44 further comprising: a circuit board disposed between the first and the second members, the board having a second passage therein, the second passage being sized to receive the second spacer as the same extends therethrough.

48. The apparatus of claim 47 wherein the axial dimension of the spacer is equal to the maximum thickness dimension of the board.

49. The apparatus of claim 46 wherein the recess in the second member has a second predetermined depth dimension and wherein the axial dimension of the spacer is equal to the maximum thickness dimension of the board plus the second depth dimension.

50. The apparatus of claim 44 wherein the first connector and the second connector each have bores therethrough, the bores in the first spacer, the first connector and the second connector being coaxially disposed when the same are secured together, the bores in the second spacer, the first connector and the second connector being coaxially disposed when the same are secured together, the apparatus further comprising:

the bolt of the securing means extending through the registered bores in the first spacer, the first connector and the second connector;

the securing means further comprising a second bolt extensible through the registered bores in the second spacer, the first connector and the second connector and a nut attachable to the second bolt.

* * * * *

UNITED STATES PATENT AND TRADEMARK OFFICE

CERTIFICATE OF CORRECTION

PATENT NO. : 5,316,487

DATED : May 31, 1994

INVENTOR(S) : Clark

It is certified that error appears in the above-indentified patent and that said Letters Patent is hereby corrected as shown below:

Col. 3, Line 32, please delete "of the Figure" and insert --of the Figures-- therefor.

Col. 3, Line 42, please delete "ends of each" and insert --end of each-- therefor.

Col. 3, Line 47, please delete "pin shroud 24 on" and insert --pin shroud 24 are shown on-- therefor.

Col. 3, Line 48, please delete "14A and 14B. respectively" and insert --14A and 14B, respectively-- therefor.

Col. 3, Line 56, please delete "dimension 26T. an inner" and insert --dimension 26T, an inner-- therefor.

Col. 3, Line 66, please delete "An array of elongated pins 4 is," and insert --An array of elongated pins 34 is,-- therefor.

Col. 4, Line 19, please delete "the endwells 44A. 44B and" and insert --the endwalls 44A, 44B and -- therefor.

Col. 4, Line 65, please delete "reproduciblily of board" and insert --reproducibility of board-- therefor.

Col. 5, Line 60, please delete "provided with a.,dally" and insert --provided with axially-- therefor.

UNITED STATES PATENT AND TRADEMARK OFFICE

CERTIFICATE OF CORRECTION

PATENT NO. : 5,316,487

DATED : May 31, 1994

INVENTOR(S) : Clark

It is certified that error appears in the above-indentified patent and that said Letters Patent is hereby corrected as shown below:

Col. 6, Line 15, please delete, "gap 84 will defined between" and insert --gap 84 will be defined between--.

Col. 10, Line 61-62, please delete "the space being generally" and insert --the spacer being generally--.

Col. 12, Line 44, please delete "a predetermined distance $L_2$ each to" and insert therefor --a predetermined distance $L_2$ equal to-- therefor Signed and Sealed this Thirty-first Day of December, 1996

*Attest:*

Bruce Lehman

BRUCE LEHMAN

*Attesting Officer*

*Commissioner of Patents and Trademarks*